United States Patent [19]

Katagiri et al.

[11] Patent Number: 4,656,690

[45] Date of Patent: Apr. 14, 1987

[54] FIREPROOF DOOR CLOSER AND HOLDER HAVING A SOLENOID AND A TOGGLE MECHANISM

[75] Inventors: Fujio Katagiri, Fuchu; Haruyuki Atsumi, Yokohama; Hisatugu Anzai, Machida; Noboru Kasahara, Fuchu, all of Japan

[73] Assignees: Ryobi Limited, Fuchu; Hochiki Corporation, Tokyo, both of Japan

[21] Appl. No.: 787,528

[22] Filed: Oct. 15, 1985

[30] Foreign Application Priority Data

Oct. 18, 1984 [JP] Japan ..... 59-158278[U]
Nov. 7, 1984 [JP] Japan ..... 59-169581[U]

[51] Int. Cl.[4] ..... E05F 15/20

[52] U.S. Cl. ..... 16/48.5; 16/49; 16/85; 16/DIG. 10; 16/DIG. 17

[58] Field of Search ..... 16/48.5, 49, 64, 65, 16/69, 70, 78, 79, 80, 85, DIG. 10, DIG. 17

[56] References Cited

U.S. PATENT DOCUMENTS 1,816,391 7/1931 Moore ..... 16/48.5

4,083,080 4/1978 Miyazawa ..... 16/69

*Primary Examiner*—Fred Silverberg

*Attorney, Agent, or Firm*—Frishauf, Holtz, Goodman & Woodward

[57] ABSTRACT

In an apparatus for closing a fireproof door, a holding device comprises a latch mechanism and a slider. The latch mechanism comprises an actuator member swingably supported in a housing which is provided with a tubular portion wherein a stopper is inserted and downwardly biased by a spring, the biasing force of the spring being adjustable by a screw which is threaded into the tubular portion. The slider is provided with an inclined surface at the front end thereof and a through-hole to receive the stopper therein. The slider is slid into the spacing formed between the actuator member and the housing with upwardly guiding the stopper by the inclined surface of the slider and the slider is locked by the stopper when it falls into the through-hole of the slider. The slider is released from the latch mechanism by swinging the actuator member or upwardly pushing the stopper against the biasing force of the spring.

8 Claims, 16 Drawing Figures

FIREPROOF DOOR CLOSER AND HOLDER HAVING A SOLENOID AND A TOGGLE MECHANISM

BACKGROUND OF THE INVENTION

This invention relates to an apparatus for closing a fireproof door, normally locked in its open position, in case of emergency such as fire either by remote-controlled energization of a solenoid or man-controlled closing force.

In the prior closing apparatus, a slider normally latched by a latch mechanism is released by remote-controlled energization of a solenoid in case of fire and the fireproof door is automatically closed by, for instance, a door closer. It is desired, however, to manually release a slider from a latch mechanism so as to close the fireproof door by man-controlled manipulation, thereby assuring a reliable unlocking even when a solenoid is in trouble.

Further, in the prior closing apparatus, latching force of the latch mechanism is normally set to a level higher than necessary to avoid a slider to be unintentionally released. However, it is desired, also, to make it possible to adjust the latching force of the latch mechanism since manual closing becomes difficult when the latching force is excessive.

In order to overcome the above defects of the prior apparatuses, an improved closing apparatus has been proposed in the U.S. patent application Ser. No. 645,921. In this apparatus, the latch mechanism comprises an actuator plate which is spring-loaded and floatably supported on an adjusting screw adapted to adjust a resilient force of a spring and is swingable around a fulcrum shaft. The slider is provided with a hook portion at the front end thereof to engage a support pin mounted at the rear end of the actuator plate.

With this apparatus, besides remote-controlled energization of a solenoid, the slider can be released from the actuator plate by transmitting a manual door closing force onto the slider as the backward sliding force therefor, provided that the backward sliding force is larger than the resilient force of the spring.

Further, as described above, the resilient force of the spring can be suitably adjusted by the adjusting screw. Thus, the defects of the prior closing apparatus have been overcome.

The above apparatus, however, as the actuator plate itself is spring-loaded and floatably supported on the adjusting screw, the actuator plate and the related parts thereof have larger-scale and complex constructions. Further, the swing operation of the actuator plate becomes not-sufficiently accurate, which causes malfunction of the closing apparatus.

SUMMARY OF THE INVENTION

Accordingly, an object of the invention is to provide a closing apparatus having a simple and compact construction and capable of being accurately operated.

According to this invention, there is provided a fireproof door closing apparatus, an apparatus for closing a fireproof door which comprises a door closer secured to the fireproof door and a holding device secured to a door wall; said holding device comprising a latch mechanism and a slider mounted in a housing; said latch mechanism comprising an actuator member swingably supported in said housing, a toggle link mechanism cooperatively connected to said actuator member, and a solenoid having a plunger; said toggle link mechanism being collapsed into V-shaped state in response to the movement of said plunger of the solenoid; and said slider being connected to said door closer and slid in said housing in response to the opening and closing of the fireproof door; the improvements which comprise in that said actuator member is provided with a tubular portion wherein a stopper is inserted and downwardly biased by a spring, the biasing force of said spring being adjustable by a screw threaded into said tubular portion; that said slider is provided with an inclined surface at the front end thereof and a through-hole to receive said stopper therein; and that said slider is slid into the spacing formed between said actuator member and the 10 housing with upwardly guiding said stopper by said inclined surface of the slider and said slider is locked by said stopper when it falls into said through-hole of the slider.

DESCRIPTION OF PREFERRED EMBODIMENTS

Figure 1:
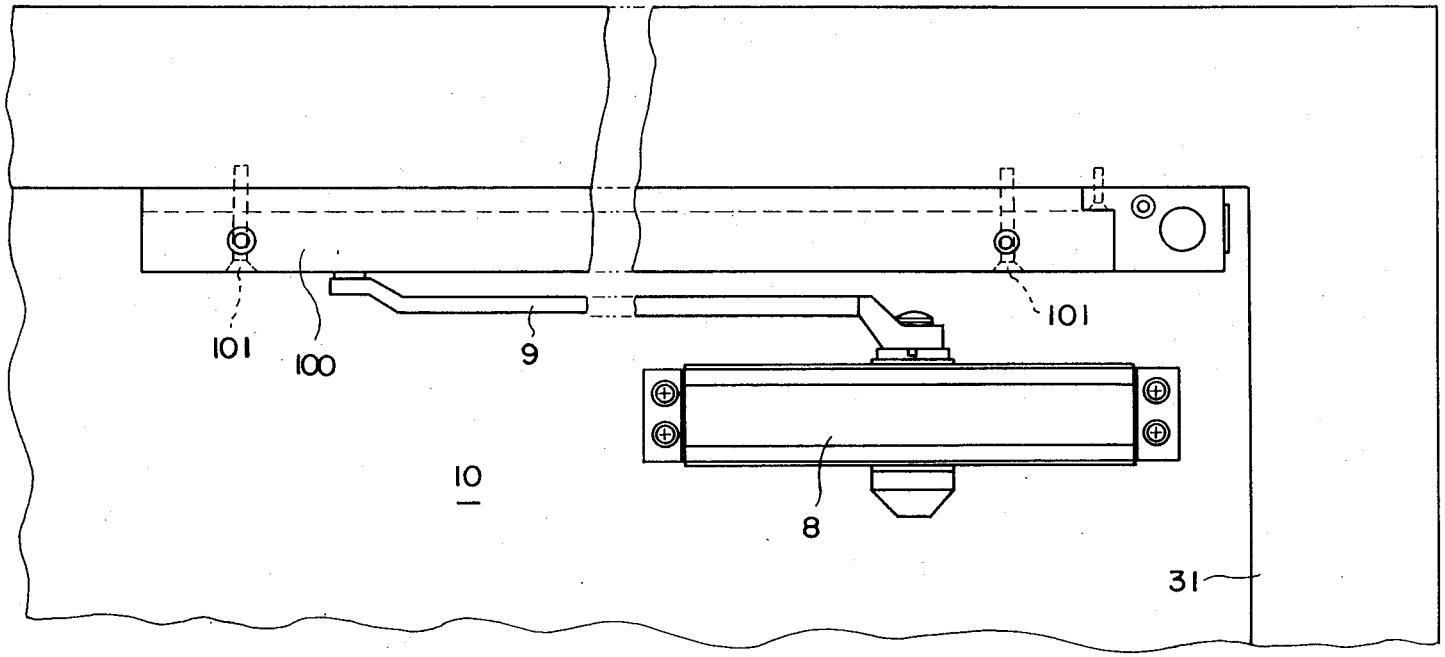
FIG. 1 is a front view showing a closing apparatus embodying the invention.
Figure 2:
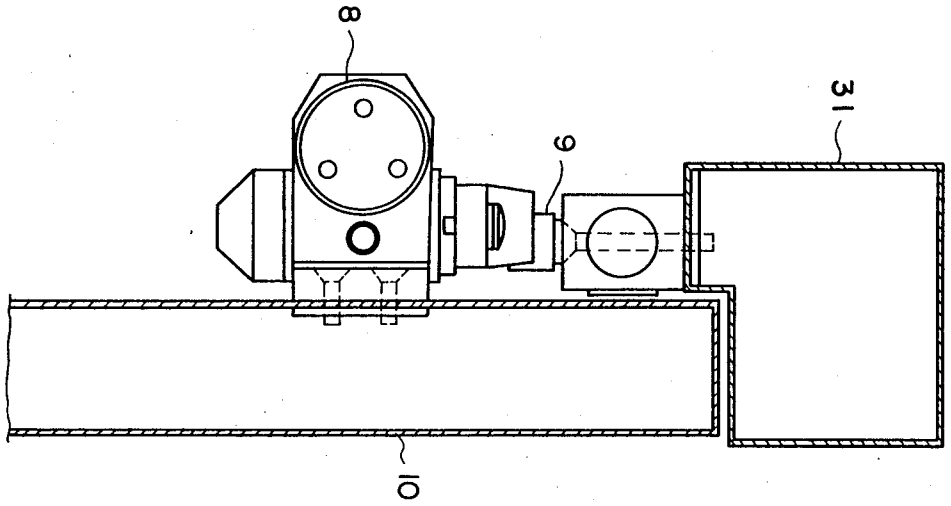
FIG. 2 is a left side view of the apparatus illustrated in FIG. 1.

A closing apparatus illustrated in FIGS. 1 and 2 comprises a holding device 100 secured by screws 101.101 to the upper portion of a door wall 31 and a door closer 8 secured to a fireproof door 10.

Figure 3:
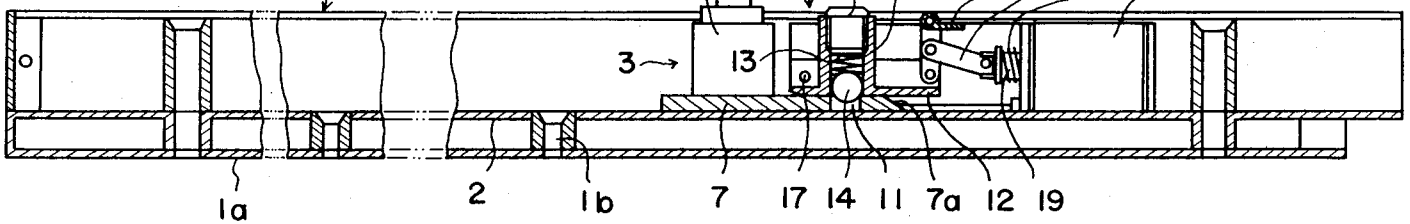
FIG. 3 is a front sectional view showing a holding device of the closing apparatus in the condition turned upside down wherein a slider is locked.
Figure 4:
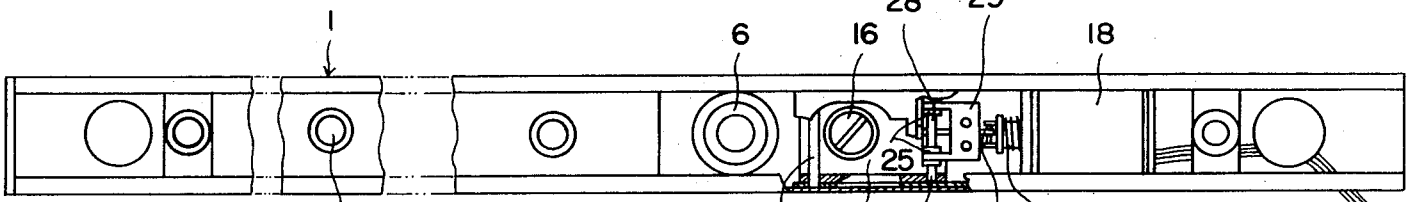
FIG. 4 is a partly-cut plan view of the holding device illustarted in FIG. 3.
Figure 5:
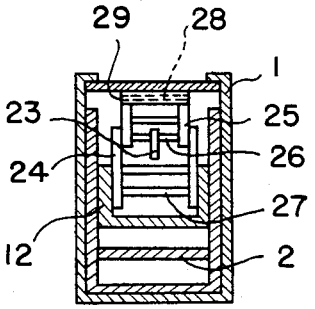
FIG. 5 is a sectional view taken along the line V—V in FIG. 4.
Figure 6:
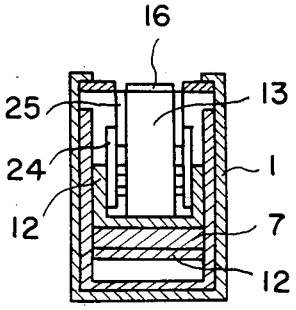
FIG. 6 is a sectional view taken along the line VI—VI in FIG. 4.
Figure 12:
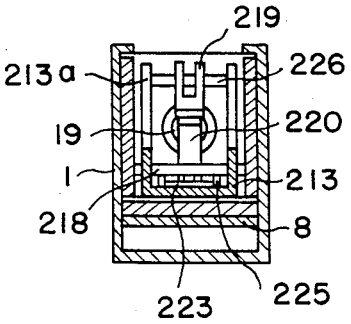
FIG. 12 is a sectional view taken along the line XII—XII in FIG. 10.
Figure 13:
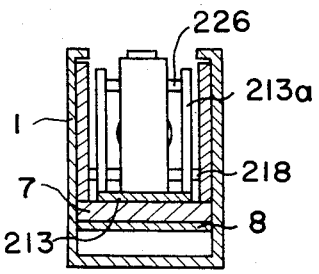
FIG. 13 is a sectional view taken along the line XIII—XIII in FIG. 10.

The holding device illustrated in FIGS. 3 and 4 comprises a slider 3 and a latch mechanism 4, both of which are mounted inside a housing 1.

The housing 1 has a square-U-shaped cross-section and an inside plate 2 is arranged along and secured to the bottom plate 1*a* of the housing 1 by a plurality of pins 1*b*.

Figure 7:
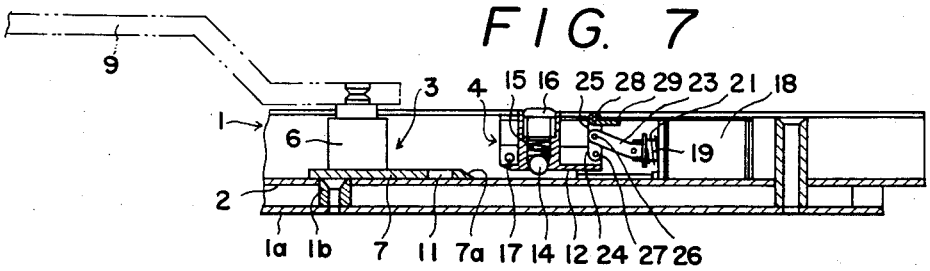
FIG. 7 is a front sectional view of the holding device wherein the slider is unlocked.

The slider 3 comprises a base plate 7 slidably mounted on the inside plate 2 and a cylindrical block 6 secured to the base plate 7. The block 6 is provided with a boss 6*a* which is protruded out of the housing 1 through the upper opening thereof. As illustrated in FIGS. 1, 2 and 7, one end of the arm 9 of the door closer 8 is pivotally connected to the boss 6*a* of the block 6 so 20 that the base plate 7 is reciprocatively slid along the inside plate 2 when the fireproof door 10 is open and closed. The base plate 7 is provided with a downwardly inclined surface 7*a* at the front end thereof, and further a through-hole 11 is formed near the front end thereof.

The latch mechanism 4 comprises an operating member 12, a toggle link mechanism 22 and a solenoid 18.

The actuator member 12 has a square-U-shaped cross-section and is provided with a tubular portion 13 vertically extending from the bottom plate thereof. The actuator member 12 is swingably pivoted to the housing 1 at the side facing to the block 6 of the slider 3 by a pivot pin 17. In the tubular portion 13, an adjusting screw 16, a spring 15 and a spherical stopper 14 are inserted. The spherical stopper 14 is downwardly biased by the spring 15, and the biasing force of the spring 15 is adjustable by threading in and out the screw 16. The diameter of the lower opening of the tubular portion 13 is reduced so that the stopper 14 is not dislocated therefrom, but a certain portion thereof may be downwardly protruded out of the tubular portion 13.

The solenoid 18 is secured to the housing 1, and a spring 21 is mounted on a plunger 19 thereof to be contracted upon the retracting movement of the plunger 19 when the solenoid 18 is energized. Then, upon de-energizing the solenoid 18, the retracted plunger 19 is forwardly thrusted by the biasing force of the contracted spring 21.

The toggle link mechanism 22 comprises a pair of links 24–25 interconnected by a toggle pin 26. One end of the link 25 is pivoted by a pin 28 to the front side of the actuator member 12, while one end of the link 24 is pivoted by a pin 27 to a link bearing plate 29 which is secured to the housing 1.

A connecting member 26 is pivoted to the toggle pin 23 at one end thereof, and the other end of the member 23 is pivoted to the front end of the plunger 19.

The above described closing apparatus operates as follows.

At the state illustrated in FIG. 7, the fireproof door 10 is closed so that the slider 3 is positioned in the left-side and is freely slidable along the inside plate 2, and the solenoid 18 is energized so that the plunger 19 is retratcted and the toggle link mechanism 22 is held at its linear state. At this state, the actuator member 12 is in parallel with the inside plate 2 to form a spacing therebetween where the base plate 7 is inserted.

Figure 8:
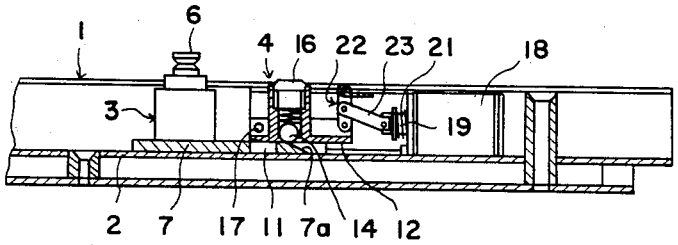
FIG. 8 is a front sectional view of the holding device wherein the slider is going to be locked.

Upon opening the fireproof door 10, the slider 3 is rightwardly moved in FIG. 7 by the arm 9 of the door closer 8 and the stopper 14 is guided by the inclined surface 7*a* of the base plate 7 and upwardly moved against the resilient force of the spring 15, as illustrated in FIG. 8. When the base plate 7 of the slider 3 reached to the position as illustrated in FIG. 3, where the fireproof door 10 is in its open position, the stopper 14 falls down into the through-hole 11 of the base plate 7 by the biasing force of the spring 15. With this engagement of the stopper 14 and the base plate 7, the fireproof door 10 is held and maintained at its opening position. The biasing force of the spring 15 applied to the stopper 14 is set to be larger than the closing force of the door closer 8.

The fireproof door 10 is closed by following two ways when the fire occurs.

One is mannual way. In this way, by manually pulling the fireproof door 10 toward its closed position, the slider 3 is forced to be leftwardly slid in FIG. 3 by the arm 9 of the door closer 8. As the toggle link mechanism 22 is held in its linear state by the solenoid 18, the actuator member 12 is maintained in its horizontal state, but the stopper 14 is upwardly moved against the biasing force of the spring 15 when the manual closing force exceeds the biasing force of the spring 15, and is released from the through-hole 11 of the base plate 7. Thus, the slider 3 becomes free to slide along the inside plate 2 and is then leftwardly moved by the closing force of the door closer 8 until the fireproof door 10 is fully closed.

Figure 9:
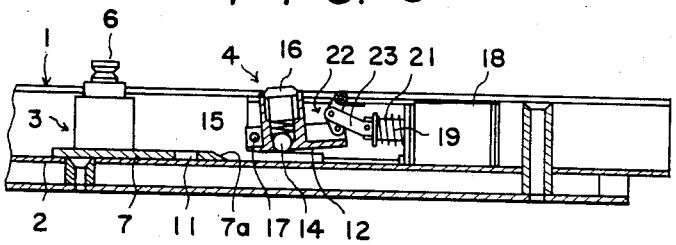
FIG. 9 is a front sectional view of the holding device wherein the slider is released.

The other way is to de-energize the solenoid 18. When the solenoid 18 is de-energized, in FIG. 3, the plunger 19 is thrusted by the resilient force of the spring 21 as illustrated in FIG. 9. With this movement of the plunger 19, the toggle link mechanism 22 is collapsed about the pin 26 as the connecting member 23 is forced to be leftwrdly moved. As one end of the upper link 25 is pivoted to the link bearing plate 29 secured to the housing 1, the end of the lower link 24 is relatively upwardly moved, so that the actuator member 12 is swung in the counter-clockwise direction about the pivot pin 17. Thereby, the stopper 14 is released from the through-hole 11 of the base plate 7. Thus, the slider 3 becomes free to slide and the fireproof door 10 is closed merely by the closing force of the door closer 8.

Figure 10:
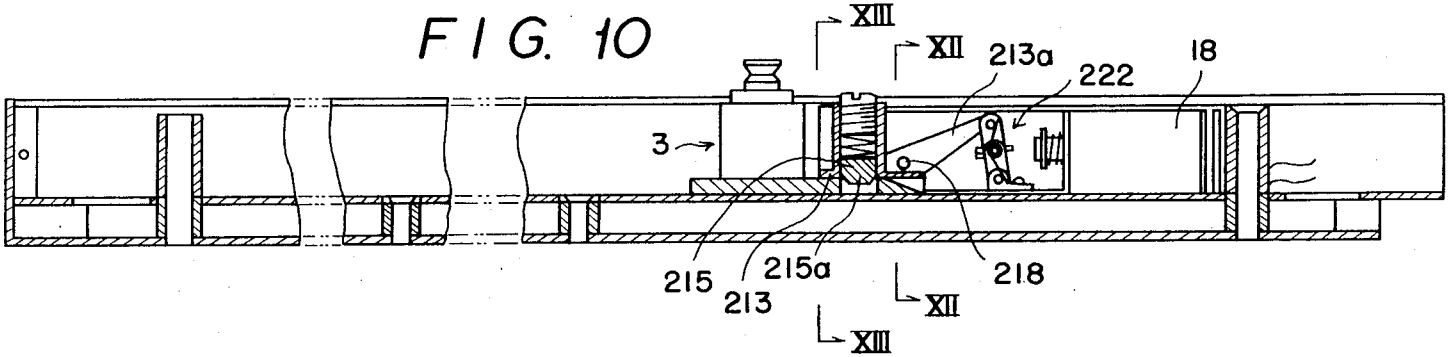
FIG. 10 is a front sectional view showing another embodiment of a holding device.
Figure 11:
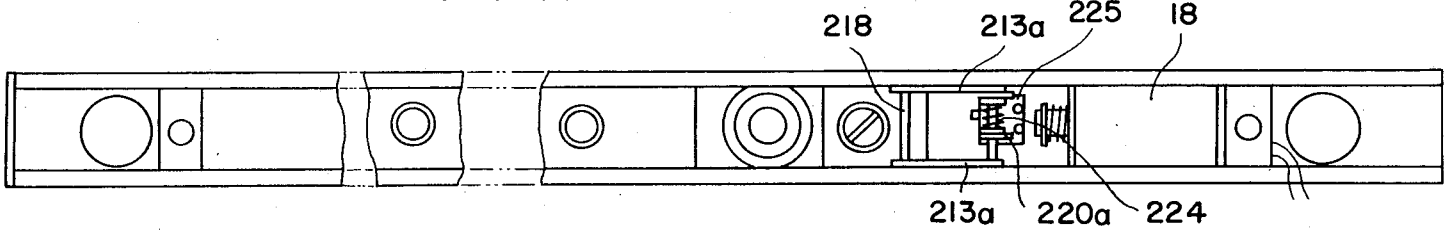
FIG. 11 is a plan view of the holding device illustrated in FIG. 10.

FIGS. 10 and 11 show another embodiment of the holding device wherein the actuator member 12 and the toggle link mechanism 22 of the latch mechanism 4 are modified.

The modified actuator member 213 is provided with a pair of upwardly inclined side plates 213*a*—213*a* extending toward the toggle link mechanism 222, and is pivoted by a pivot pin 218 to the housing 1 at the base ends of the side plates 213*a*—213*a*. The stopper 215 is also modified to have cylindrical configuration, the diameter of the lower portion 215*a* of which is gradually reduced. The diameter of the lower opening of the tubular portion 13 is reduced so that the stopper 215 is not dislocated therefrom, but the lower portion 215*a* thereof may be protrudable out of the tubular portion 13.

The modified toggle link mechanism 222 comprises a pair of upper and lower links 219–220 which are interconnected by a pivot pin 221. The lower end of the link 220 is pivoted by a pin 223 to a link bearing plate 225 secured to the inside plate 2, while the upper end of the link 219 is pivoted by a pivot pin 226 to the front ends of the side plates 213*a*—213*a* of the actuator member 213. The lower link 220 has, at a position confronting the plunger 19 of the solenoid 18, a boss 220*a* formed integrally with the link 220, on 20 which the plunger 19 strikes when the latter is forwardly thrusted. A toggle spring 224 is wound around the pivot pin 221, both ends of which are secured to the links 219–220, respectively, in order to bias the toggle link mechanism 222 selectively into the linear or V-shaped state.

The above holding device operates as follows.

Figure 14:
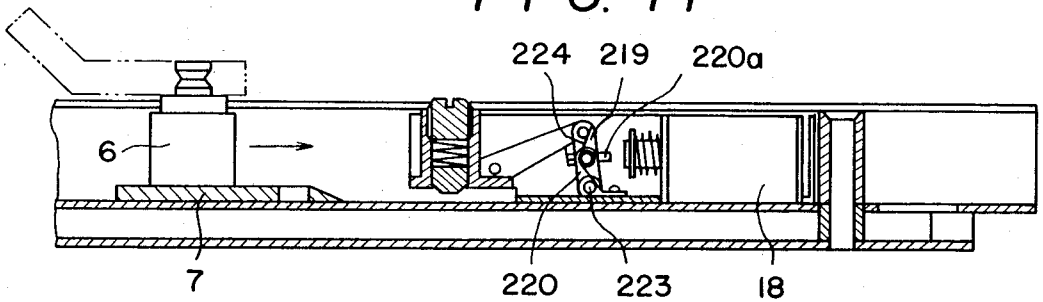
FIG. 14 is a front sectional view of the holding device wherein the slider is unlocked.

At the state illustrated in FIG. 14, the operating member 213 is in parallel with the inside plate 2 to form a spacing therebetween where the base plate 7 is inserted.

Figure 15:
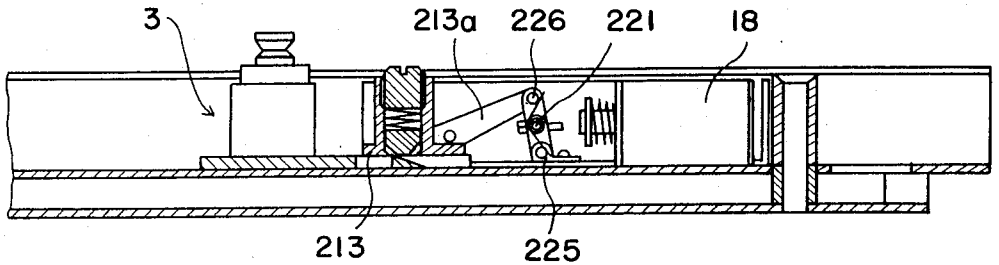
FIG. 15 is a front sectional view of the holding device wherein the slider is going to be locked.

Upon opening the fireproof door 10, the slider 3 is rightwardly moved in FIG. 14, and the stopper 215 is guided by the inclined surface 7*a* of the base plate 7 to be upwardly moved, as illustrated in FIG. 15. When the base plate 7 reached to the position as illustrated in FIG. 10 where the fireproof door 10 is in its open position, the stopper 215 falls down into the through-hole 11 of the base plate 7 by the biasing force of the spring 15. With this engagement of the stopper 215 and the base plate 7, the fireproof door 10 is held and maintained at its opening position.

The fireproof door 10 is closed by the following two ways similarly as the first enbodiment.

One is manual way. In this way, by manually pulling the fireproof door 10 toward its closed position, the slider 3 is forced to be leftwardly slid in FIG. 10 by the arm 9 of the door closer 8. As the toggle link mechanism 222 is held in its linear state by the spring 224, the operating member 213 is maintained in its horizontal state, but the stopper 215 is upwardly moved against the biasing force of the spring 15 when the manual closing force exceeds the resilient force of the spring 15, and is released from the through-hole 11 of the base plate 7. Thus, the slider 3 becomes free to slide along the inside plate 2 and is then leftwardly moved by the closing force of the door closer 8 until the fireproof door 10 is closed.

Figure 16:
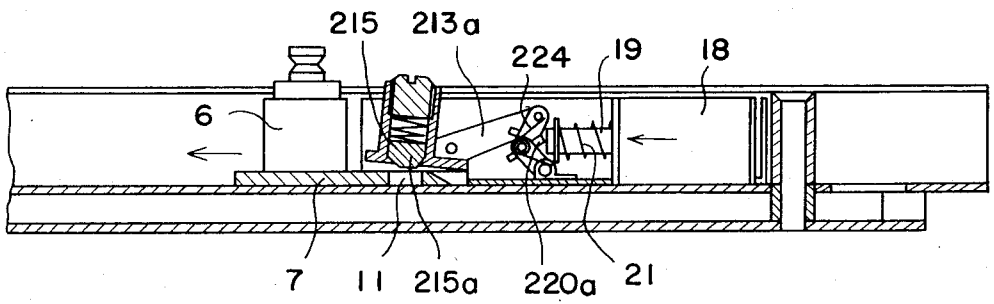
FIG. 16 is a front sectional view of the holding device wherein the slider is released.

The other way is to de-energize the solenoid 18. When the solenoid 18 is de-energized, in FIG. 10, the plunger 19 is forwardly thrusted by the resilient force of the spring 21 as illustrated in FIG. 16. With this movement of the plunger 19, the plunger 19 strikes on the boss 220*a* and collapses the toggle link mechanism 222 into V-shaped state around the toggle pin 221. Such collapse of the toggle link mechanism 222 causes the actuator member 213 to swing around the pivot pin 218 in the clockwise direction, as the upper end of the link 219 is pivotaly connected to the front ends of the side plates 213*a*—213*a* of the actuator member 213, while the lower end of the link 220 is secured to the link bearing plate 225. Thereby, the stopper 215 is released from the through-hole 11 of the base plate 7. Thus, the base plate 7 becomes free to slide and the fireproof door 10 is closed by the closing force of the door closer 8.

Thus, with the closing apparatus as above described, even if an automatic remote actuation is in trouble, the fireproof door can be assurely closed simply by drawing the door out, and it is further possible to adjust an appropriate releasing force according to each particular size of the fireproof door.

What is claimed is:

1. An apparatus adapted for use with a fireproof door which is normally held open and which is closed manually or automatically in response to a signal generated when fire is detected, said apparatus comprises a door closer secured to the fire proof door and a holding device secured to an upper portion of a door wall;

said holding device comprising a latch mechanism and a slider mounted in a housing;

said latch mechanism comprising an actuator member and first means for swingably supporting the actuator in said housing, a toggle link mechanism, and second means for cooperatively connecting the toggle link mechanism to said actuator member, a solenoid having a plunger, and means for securing said solenoid to the housing;

said toggle link mechanism being collapsed into a V-shaped state in response to the movement of said plunger of the solenoid; and said slider being connected to said door closer and slidably received in said housing in response to the opening and closing of the fireproof door;

the improvements which comprise in that said actuator member is provided with a tubular portion wherein a stopper is inserted and downwardly biased by a spring, the biasing force of said spring being adjustable by a screw threaded into said tubular portion;

that said slider is provided with an inclined surface at the front end thereof and a recess to receive said stopper therein; and that said slider is slid into the spacing formed between said actuator member and the housing with said stopper being upwardly guided by said inclined surface of the slider, and said slider is locked by said stopper when it falls into said recess of the slider.

2. The apparatus according to claim 1, wherein said toggle link mechanism comprises a pair of upper and lower link members connected by a central toggle pin with each other and a toggle spring wound about said central toggle pin which biases the toggle link mechanism selectively into a linear or V-shaped state.

3. The apparatus according to claim 2, wherein any one of said link members is provided with a boss facing the front end of said plunger of the solenoid to be striked upon the forward thrusting of said plunger.

4. The apparatus according to claim 3, wherein said plunger is spring-biased to be thrusted toward said boss of the link member.

5. The apparatus according to claim 1 wherein said toggle link mechanism comprises a pair of upper and lower link members connected by a central toggle pin with each other, said central toggle pin being interconnected to said plunger.

6. The apparatus according to claim 1 wherein said stopper is spherical and the diameter of the lower opening of said tubular portion is reduced so that said spherical stopper is not dislocated from said actuator member but a certain portion thereof can be downwardly protruded out of said actuator member.

7. The apparatus according to claim 1 wherein said stopper has a cylindrical shape, the lower portion of which is reduced, and the diameter of the lower opening of said tubular portion is reduced so that said cylindrical stopper is not dislocated from said actuator member but the lower portion having reduced-diameter can be downwardly protruded out of said actuator member.

8. The apparatus according to claim 1 wherein said toggle link mechanism comprises a pair of upper and lower link members connected by a central toggle pin, and the free end of any one of the link members is secured to said housing while the free end of the other of the link members is connected to said actuating member so as to swing said actuator member upon the collapse of said toggle mechanism.

* * * * *